US007047583B2

(12) United States Patent
Kim et al.

(10) Patent No.: US 7,047,583 B2
(45) Date of Patent: May 23, 2006

(54) WASHING MACHINE AND METHOD OF CONTROLLING THE SAME

(75) Inventors: Hyung-Kyoon Kim, Suwon (KR); Sang-Yeon Pyo, Suwon (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 561 days.

(21) Appl. No.: 10/318,104

(22) Filed: Dec. 13, 2002

(65) Prior Publication Data

US 2004/0006831 A1 Jan. 15, 2004

(30) Foreign Application Priority Data

Jul. 9, 2002 (KR) ..... 2002-39693

(51) Int. Cl.
*D06F 39/08* (2006.01)

(52) U.S. Cl. ..... 8/159; 68/12.04

(58) Field of Classification Search ..... 8/158, 8/159; 68/12.04
See application file for complete search history.

(56) References Cited

U.S. PATENT DOCUMENTS 2,138,501 A * 11/1938 Miller ..... 68/152
2,265,516 A * 12/1941 Chayie ..... 68/21
2,645,111 A * 7/1953 Fields ..... 68/23.6
2,715,826 A * 8/1955 Kirby ..... 68/23.6
2,902,851 A * 9/1959 Fields ..... 68/131
4,235,085 A * 11/1980 Torita ..... 68/12.04
4,607,408 A * 8/1986 Didier et al. ..... 8/159
4,862,710 A * 9/1989 Torita et al. ..... 68/12.01
5,092,140 A * 3/1992 Matsuo et al. ..... 68/12.04
5,161,393 A * 11/1992 Payne et al. ..... 68/12.04
5,233,847 A * 8/1993 Tanaka ..... 68/12.04
5,337,431 A * 8/1994 Kim et al. ..... 8/159
5,460,018 A * 10/1995 Werner et al. ..... 68/23.6
6,064,165 A * 5/2000 Boisvert et al. ..... 318/465
6,115,863 A * 9/2000 Mason et al. ..... 8/159
6,442,979 B1 * 9/2002 Thorn et al. ..... 68/12.16
6,760,942 B1 * 7/2004 Lee et al. ..... 8/159
2002/0050011 A1 5/2002 Cho et al.

* cited by examiner

*Primary Examiner*—Frankie L. Stinson
(74) *Attorney, Agent, or Firm*—Staas & Halsey LLP

(57) ABSTRACT

A washing machine which washes laundry by wobbling a washing board mounted on an inner surface of a bottom of a spin-drying tub, and a method of controlling the same. The washing machine includes a weight detection unit and a control unit. The weight detection unit detects a weight of the laundry using an amount of current flowing through a drive motor of the washing machine, which is used to drive the spin-drying tub and the washing board. The control unit controls an entire washing operation of the washing machine to correspond to the detected weight of the laundry.

16 Claims, 5 Drawing Sheets

WASHING MACHINE AND METHOD OF CONTROLLING THE SAME

CROSS-REFERENCE TO RELATED APPLICATIONS

This application claims the benefit of Korean Patent Application No. 2002-39693 filed on Jul. 9, 2002, in the Korean Intellectual Property Office, the disclosure of which is incorporated herein by reference.

BACKGROUND OF THE INVENTION

1. Field of the Invention

The present invention relates to a washing machine and a method of controlling the same, and more particularly, to a washing machine which washes laundry by wobbling a washing board thereof and a method of controlling the same.

2. Description of the Related Art

Generally, a washing machine is an apparatus which washes laundry by rotating a cylindrical rotating tub containing the laundry and washing water. Such washing machines may be divided into drum-type washing machines and vertical-axis washing machines. A drum-type washing machine allows a rotating tub to be horizontally disposed, and washes laundry using impact that is obtained as the laundry is lowered by gravitation, after being raised up along an inner surface of the rotating tub, while the rotating tub is rotated around a horizontal axis in forward and reverse directions. In contrast, a vertical-axis washing machine allows a spin-drying tub equipped with a pulsator therein to be vertically disposed, and washes laundry using water currents generated by the pulsator, while the spin-drying tub is rotated around a vertical axis in forward and reverse directions. In conventional drum-type washing machines and vertical-axis washing machines, the amount of laundry is ascertained by detecting a number of rotations of a motor that are caused by inertia, once a driving of a rotating spin-drying tub or a pulsator is stopped.

Another type of vertical-axis washing machine has a wobbling device and washes laundry by exerting a mechanical impact to the laundry, in upward and downward directions, through the use of the wobbling device which reciprocates in upward and downward directions. Such a wobbling washing machine uses a mechanical impact energy generated by the wobbling device, instead of currents of wash water, and requires a smaller amount of wash water and detergent as compared to the general vertical-axis washing machine described above.

FIG. 1 shows an inner structure of a conventional vertical-axis washing machine having a wobbling device which is situated in, for example, a level position. A "wobbling position" indicates a position in which the wobbling device allows a washing board of the washing machine to be slantingly disposed so as to have the washing board be wobbled in upward and downward directions. A "level position" indicates a position in which the wobbling device allows the washing board to be horizontally disposed so as not to have a wobbling of the washing board.

As shown in FIG. 1, the washing machine comprises a housing 1, a water tub 2 mounted in the housing 1, a spin-drying tub 3 mounted inside of the water tub 2 and provided with a plurality of drain holes 3*c*, a drive motor 5 and a power transmission unit 6 mounted under the water tub 2, and a wobbling device 20 mounted in the lower portion of the spin-drying tub 3.

A drain hose 8 is provided under the water tub 2 and extends to the outside so as to drain wash water contained in the water tub 2 to the outside of the washing machine after a washing operation. A pump motor 11 and a restoring pipe 12 which circulate the wash water supplied to the water tub 2 to an upper portion of the water tub 2 are provided as shown, so as to reduce the amount of water used. Additionally, a water supply valve 13 is disposed in a water supply conduit connected to an outside hydrant (not shown).

A spin-drying shaft support 9 is mounted on an outer surface of a bottom 3*a* of the spin-drying tub 3. A spin-drying shaft 6*a* of the power transmission unit 6 is fitted into a center of the spin-drying shaft support 9 and rotates the spin-drying tub 3. A washing shaft 6*b* is positioned in the spin-drying shaft 6*a*. An upper end of the washing shaft 6*b* extends over an upper end of the spin-drying shaft 6*a* by a predetermined length to be coupled to the wobbling device 20.

FIG. 2 shows the washing machine shown in FIG. 1 with the wobbling device 20 switched to a wobbling position. The wobbling device 20 is mounted on an inner surface of the bottom 3*a* of the spin-drying tub 3. Where the wobbling device 20 is switched to the wobbling position as shown in FIG. 2, the washing machine washes laundry by wobbling the laundry in upward and downward directions using the wobbling device 20. Thereafter, the washing machine spin-dries the laundry by rotating the wobbling device 20, together with the spin-drying tub 3, with the wobbling device 20 switched to a level position, as shown in FIG. 1.

Where the wobbling device 20 is situated in the wobbling position, the wobbling device 20 is rotated by a rotating force of the drive motor 5. However, the rotating movement of the wobbling device 20 is converted into a rectilinear movement, and this rectilinear movement is transmitted to the laundry. Accordingly, detecting an amount of the laundry through detecting a number of rotations of the drive motor 5 is not effective in such a case. Additionally, where the wobbling device 20 is situated in the level position, the wobbling device 20 and the spin-drying tub 3 are rotated together by a rotation of the drive motor 5. Accordingly, in this case, the amount of laundry cannot be effectively detected by detecting a number of rotations of the drive motor 5.

SUMMARY OF THE INVENTION

Accordingly, an aspect of the present invention is to provide a wobbling washing machine and a method of controlling the same, which is capable of precisely detecting an amount of laundry by detecting an amount of current flowing through a drive motor while the drive motor is operated.

Additional aspects and advantages of the invention will be set forth in part in the description which follows and, in part, will be obvious from the description, or may be learned by practice of the invention.

To achieve the above and other aspects of the present invention, there is provided a washing machine comprising a housing which defines an outer appearance of the washing machine, a spin-drying tub to receive laundry, a washing board which is mounted on an inner surface of a bottom of the spin-drying tub and wobbles to wash the laundry, a drive motor which drives the spin-drying tub and the washing board, a weight detection unit which detects a weight of the laundry according to an amount of current flowing through the drive motor to drive the spin-drying tub and the washing board, and a control unit which controls an entire washing operation of the washing machine to correspond to the detected weight of the laundry.

To achieve the above and other aspects of the present invention, there is provided a method of controlling a washing machine having a spin-drying tub, a washing board which is mounted on an inner surface of a bottom of the spin-drying tub and wobbles to wash laundry, and a drive motor which drives the spin-drying tub and the washing board, the method comprising detecting a weight of the laundry using an amount of current flowing through the drive motor while the drive motor is operated to drive the spin-drying tub, having the laundry, and the washing board, supplying a proper amount of washing water corresponding to the detected weight of the laundry, and carrying out a washing operation, a rinsing operation and a spin-drying operation of the washing machine by wobbling the washing board in response to the supplying of the washing water being completed.

BRIEF DESCRIPTION OF THE DRAWINGS

These and other aspects and advantages of the present invention will become apparent and more readily appreciated from the following description of the embodiments, taken in conjunction with the accompanying drawings of which.

DETAILED DESCRIPTION OF THE PREFERRED EMBODIMENTS

Figure 1:
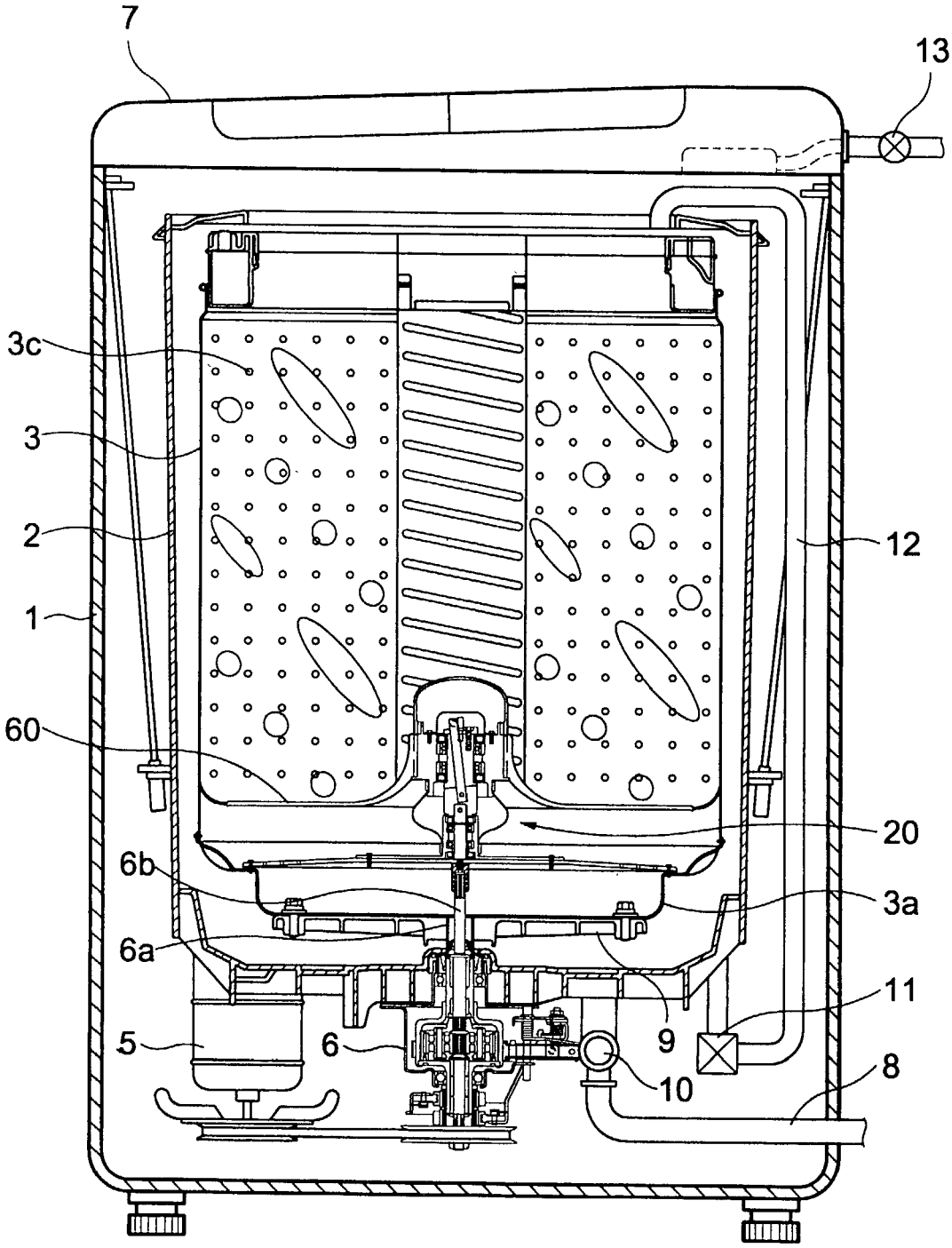
FIG. 1 (PRIOR ART)
FIG. 1 is a longitudinal sectional view illustrating an inner structure of a conventional vertical-axis washing machine having a wobbling device, where the wobbling device is situated in a level position.
Figure 2:
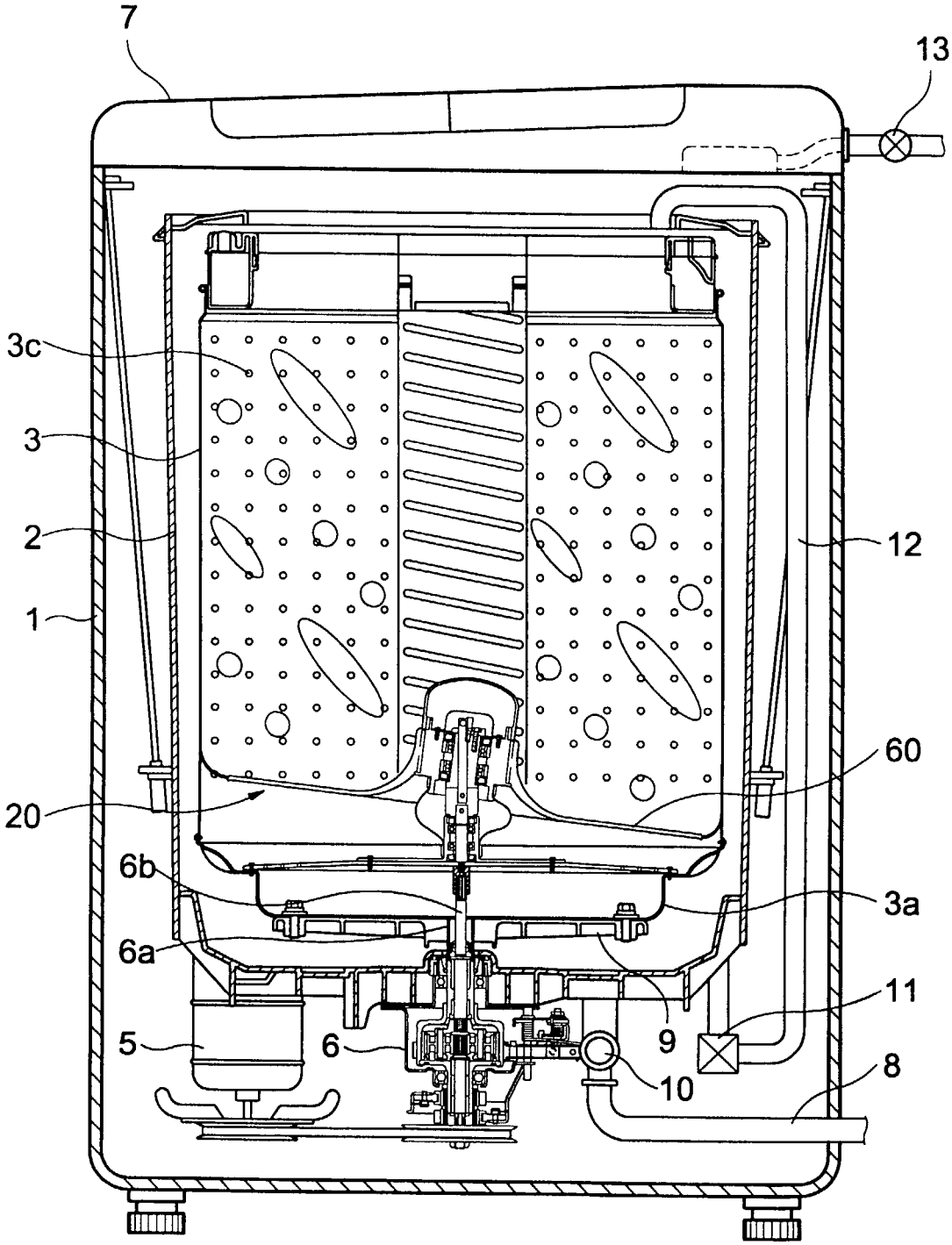
FIG. 2 (PRIOR ART)
FIG. 2 is a longitudinal sectional view illustrating the inner structure of the vertical-axis washing machine shown in FIG. 1 with the wobbling device switched to a wobbling position.

Reference will now be made in detail to the embodiments of the present invention, examples of which are illustrated in the accompanying drawings, wherein like reference numerals refer to the like elements throughout. The embodiments are described below in order to explain the present invention by referring to the figures.

Figure 3:
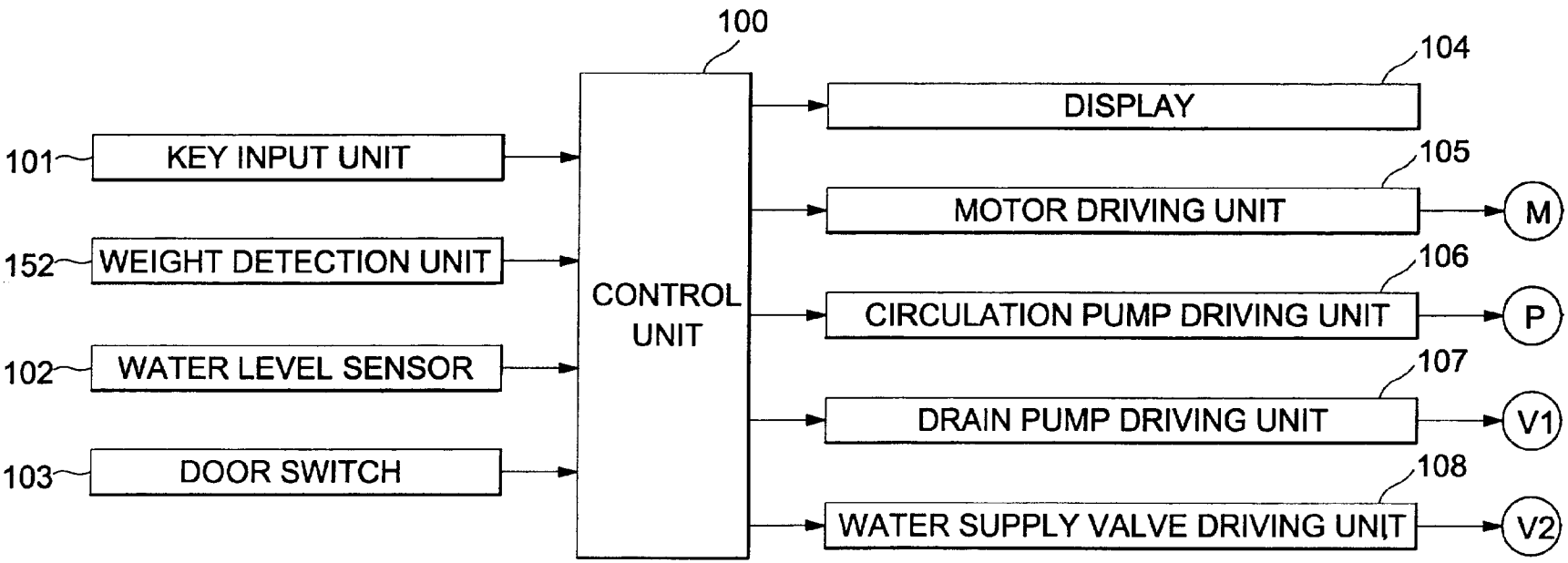
FIG. 3 is a block diagram showing a control-related construction of a vertical-axis washing machine having a wobbling device according to an embodiment of the present invention.

FIG. 3 shows a block diagram illustrating a control-related construction of a vertical-axis washing machine according to an embodiment of the present invention.

Referring to FIG. 3, a control unit 100 controls the entire operation of the vertical-axis washing machine ("washing machine") having a wobbling device (not shown).

A key input unit 101, a weight detection unit 152, a water level sensor 102, and a door switch 103 are connected to input terminals of the control unit 100. The key input unit 101 receives washing information including a washing course from, for example, a user. The weight detection unit 152 operates a drive motor M of the washing machine prior to a supply of wash water, and detects an amount of laundry contained in a spin-drying tub of the washing machine using an amount of current flowing through the drive motor M. The water level sensor 102 detects a water level of the wash water supplied to a water tub of the washing machine. The door switch 103 detects an opening and closing of a door of the washing machine.

A display 104, a motor driving unit 105, a circulation pump driving unit 106, a drain valve driving unit 107 and a water supply valve driving unit 108 are connected to output terminals of the control unit 100. The display 104 displays an operation of the washing machine. The motor driving unit 105 operates the drive motor M, which is used to operate the wobbling device and the spin-drying tub. The circulation motor driving unit 106 drives a pump motor P of the washing machine, which is used to circulate the wash water supplied to the water tub to an upper portion of the water tub to reduce the amount of the wash water being used. The drain valve driving unit 107 drives a drain valve V1 of the washing machine, which is used to drain the wash water, used to wash the laundry, to the outside of the washing machine. The supply valve driving unit 107 drives a water supply valve V2 of the washing machine, which is used to shower-rinse the laundry by feeding the wash water toward an inner surface of the spin-drying tub rotating at a low speed.

Figure 4:
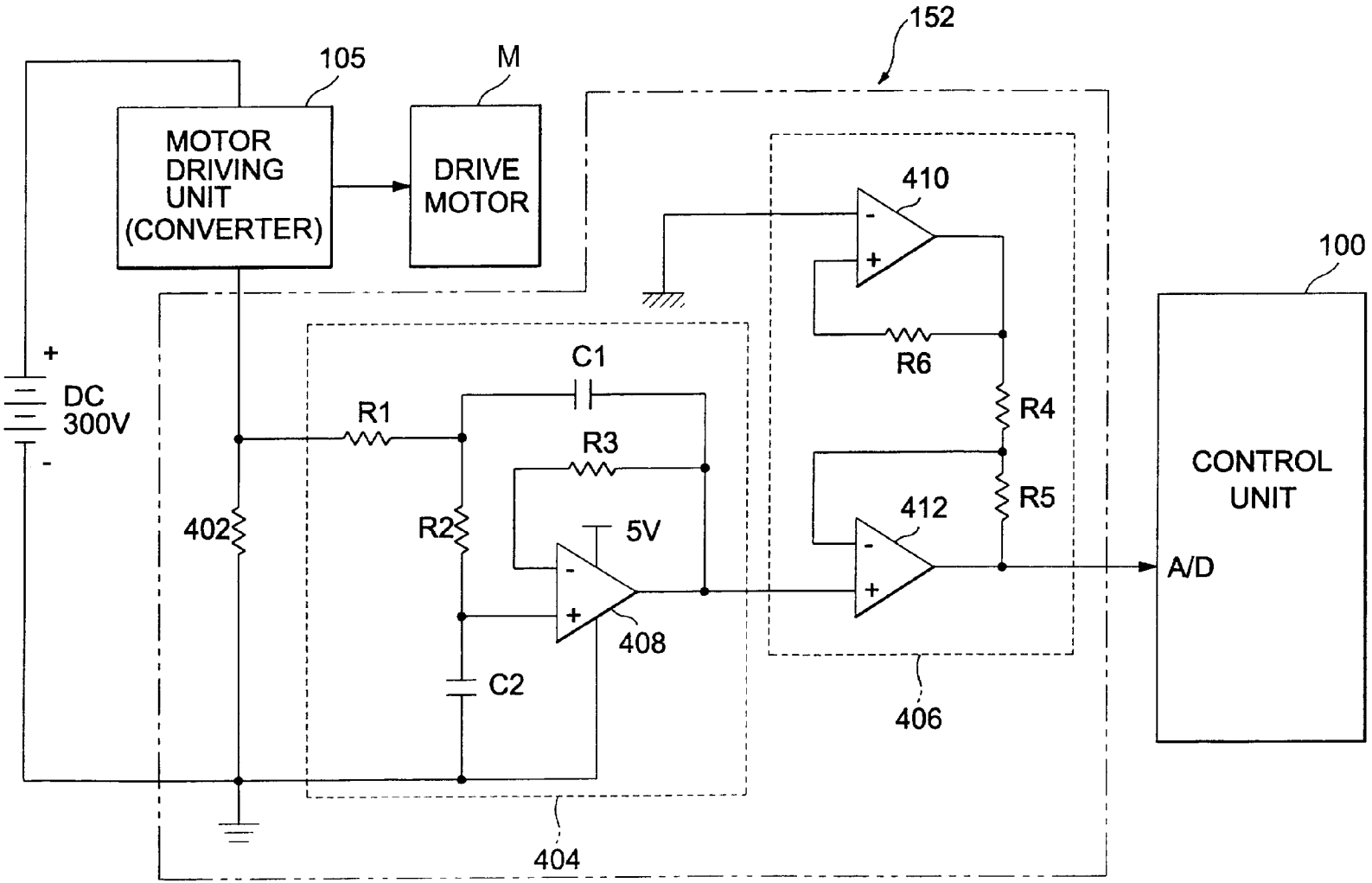
FIG. 4 is a circuit diagram illustrating the construction of a weight detection unit of a vertical-axis washing machine of the present invention.

FIG. 4 shows a circuit diagram illustrating the construction of the weight detection unit 152 of the washing machine of the present invention. As depicted in FIG. 4, a direct current voltage of, for example, 300V is supplied to the motor driving unit 105. A resistor 402 is connected between the motor driving unit 105 and a ground, and serves to detect the amount of current flowing through the motor driving unit 105. Noise may be included in the current flowing through the resistor 402. Such noise is removed from the current by using a noise filter 404. A current signal passed through the noise filter 404 is sufficiently amplified by a current amplification circuit 406 to be recognized by the control unit 100.

The current signal passed through the current amplification circuit 406 is input to the control unit 100 through an analog-digital conversion port A/D. The control unit 100 detects a weight of the laundry using the extent of the current signal converted into a digital signal, and sets washing conditions, including a level of supplied wash water, washing time, rinsing time, and spin-drying time according to the detected weight of the laundry.

Figure 5:
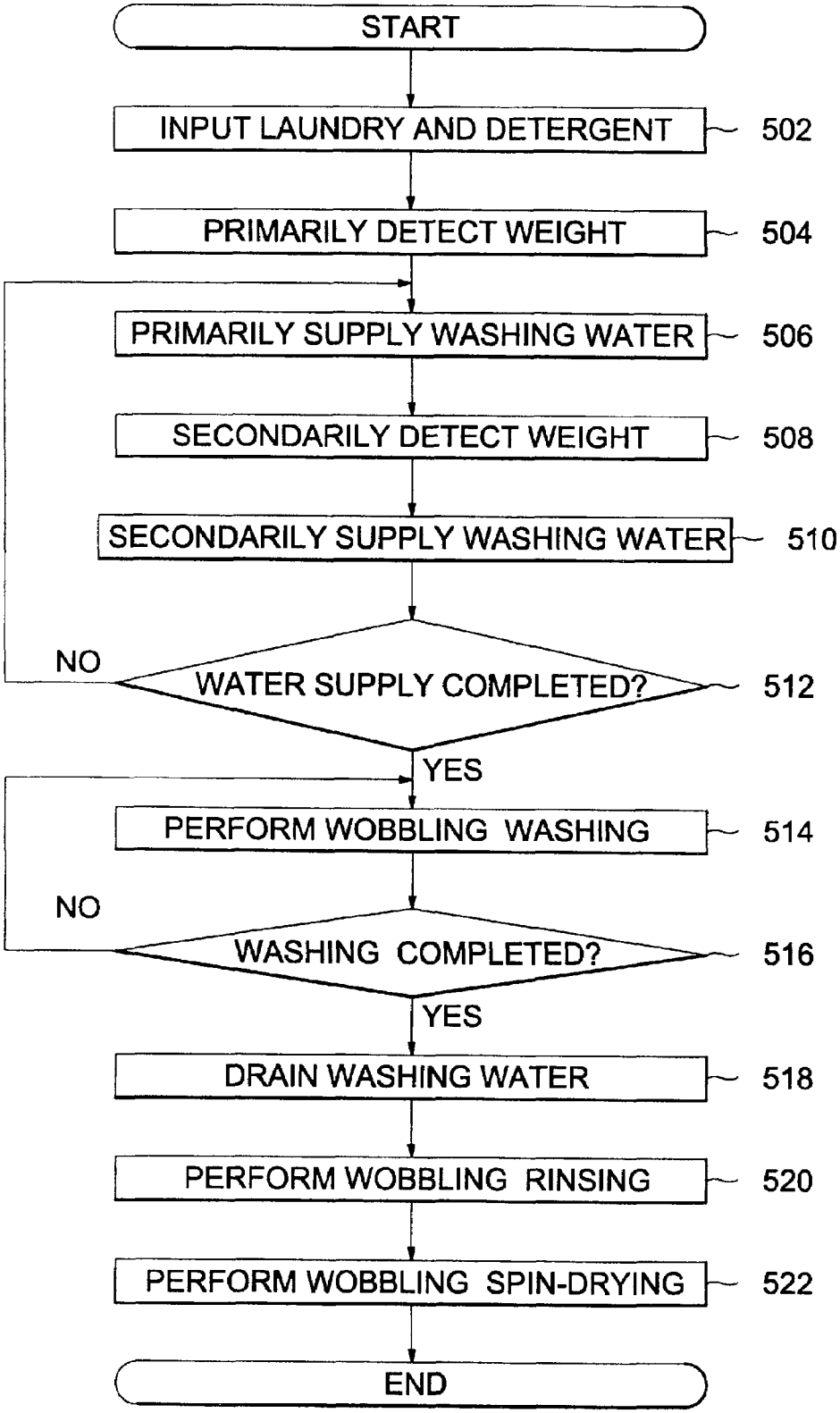
FIG. 5 is a flowchart illustrating a method of operating a vertical-axis washing machine of the present invention.

FIG. 5 shows a flowchart illustrating a method of operating the washing machine of the present invention. As illustrated in FIG. 5, where a user inputs washing information, for example, through the key input unit 101 and manipulates a starting key after placing laundry and detergent in the spin-drying tub in operation 502, the control unit 100 operates the drive motor M in a forward direction for a certain period of time in response to a corresponding key signal. At this time, the control unit 100 primarily detects a weight of the laundry through the weight detection unit 152 in operation 504.

A weight detection algorithm employed in the control unit 100 and the weight detection unit 152 is described below. First, current flowing through the drive motor M is measured while the drive motor M is operated in a forward direction for a certain period of time. In this case, data obtained for, for example, the first 500–1000 ms in an early stage of the operation are ignored because a current measurement error is great in this period of time. An average of data obtained for a predetermined period of time (for example, 10 seconds) after the early stage is taken. For example, final current extent data are obtained by taking data at intervals of 100 ms and calculating an average of ten pieces of data for each of 10 seconds, and calculating an average of the ten average samples calculated for the 10 seconds.

The control unit 100 calculates a minimum target water level corresponding to the primarily detected weight of the laundry, and primarily supplies water to the water tub by opening the water supply valve V2 in operation 506. Where the primary water supply has been completed, the control unit 100 secondarily detects a weight of the laundry while operating the drive motor M in the wobbling position, in operation 508. Where a new target water level is determined according to the secondarily detected weight of the laundry, the control unit 100 secondarily supplies the wash water to the water tub in operation 510.

The control unit 100 determines whether the water supply has been completed by checking a current water level against a determined target water level through the water level sensor 102 in operation 512. Where the wash water has been supplied to the determined target water level, the water supply is stopped and a washing operation is carried out with the wobbling device disposed in the wobbling position in operation 514. In this wobbling washing operation, a washing board of the washing machine is slantingly disposed by the wobbling device in the wobbling position. As a result, the washing board is wobbled in upward and downward directions while being slanted at a certain angle, thus washing the laundry using an impact generated by the wobbling of the washing board. In this case, the control unit 100 circulates the wash water and the detergent to an upper portion of the water tub by driving the pump motor P.

Once the wobbling washing operation has been completed in operation 516, the control unit 100 drains the wash water by opening a drain valve V1 in operation 518, and carries out a wobbling rinsing operation and a wobbling spin-drying operation in due course in operations 520 and 522, respectively.

An example of the wobbling rinsing operation of the present invention is carried out as described below. First, the control unit 100 switches the wobbling device to the wobbling position and carries out a wobbling, in which the washing board is wobbled several times to disentangle the laundry. After the wobbling is carried out, the control unit 100 switches the wobbling device to a level position while supplying rinsing water, and rotates the washing board at low speed, together with the spin-drying tub. Where the rinsing water has been supplied to a water level required for the rinsing operation, the control unit 100 rinses the laundry by wobbling the washing board. During the rinsing operation, the control unit 100 circulates the rinsing water in the water tub by driving the pump motor P.

An example of the spin-drying operation of the present invention is carried out as described below. The control unit 100 rotates the washing board together with the spin-drying tub while maintaining the washing board in the wobbling position, by operating the drive motor M in a forward direction. After a predetermined spin-drying time elapses, the control unit 100 terminates the spin-drying operation by stopping the drive motor M. Where the spin-drying operation has been completed as described above, the control unit 100 shakes the laundry contained in the spin-drying tub by wobbling the washing board, thus allowing a user to easily withdraw the laundry from the spin-drying tub. Additionally, the wobbling of the washing board, which is carried out after the spin-drying operation, decreases the amount of wrinkles in the laundry even though a certain period of time may have elapsed without the laundry being withdrawn from the spin-drying tub.

As described above, the present invention provides a washing machine that washes laundry by wobbling a washing board mounted on an inner surface of a bottom of a spin-drying tub and a method of controlling the same. The washing machines precisely detects a weight of the laundry by using an amount of current flowing through a drive motor of the washing machine, while the drive motor is operated to drive the washing board.

Although a few embodiments of the present invention have been shown and described, it will be appreciated by those skilled in the art that changes may be made in these embodiments without departing from the principles and spirit of the invention, the scope of which is defined in the appended claims and their equivalents.

What is claimed is:

1. A washing machine comprising:

a housing which defines an outer appearance of the washing machine;

a spin-drying tub to receive laundry;

a washing board which is mounted on an inner surface of a bottom of the spin-drying tub and wobbles to wash the laundry;

a drive motor which drives the spin-drying tub and the washing board;

a weight detection unit which primarily detects a weight of the laundry according to an amount of current flowing through the drive motor to drive the spin-drying tub and the washing board prior to supplying wash water into spin-drying tub, and which secondarily detects the weight of the laundry while operating the drive motor in a wobbling position, wherein a target water level is determined according to the secondarily detected weight of the laundry and water is secondarily supplied corresponding to the target water level; and a control unit which controls an entire washing operation of the washing machine to correspond to the detected weight of the laundry.

2. The washing machine according to claim 1, wherein the weight detection unit includes a current detection unit which detects the amount of the current and generates a current signal corresponding to the detected amount of the current.

3. The washing machine according to claim 2, wherein the weight detection unit further includes:

a noise removal unit which removes noise from the current signal; and a current amplification unit which amplifies the current signal passed through the noise removal unit, and supplies the amplified current signal to the control unit.

4. The washing machine according to claim 2, wherein the current detection unit is a resistor element connected between the drive motor and a potential.

5. The washing machine according to claim 4, wherein the potential is an electrical ground.

6. The washing machine according to claim 2, wherein the control unit includes an analog-digital conversion port and detects the weight of the laundry according to an extent of the current signal being converted into a digital signal.

7. The washing machine according to claim 1, further comprising:

a key input unit to receive washing information;

a water level sensor unit which detects a water level of washing water supplied to the washing machine;

a door which opens and closes an opening of the washing machine; and a door switch which detects an opening and closing of the door, wherein the key input, weight detection, water level sensor, and door switch units are connected to corresponding input terminals of the control unit.

8. The washing machine according to claim 7, further comprising:

a display unit which displays an operation of the washing machine;

a motor driving unit which drives the drive motor;

a pump motor which circulates the washing water in the washing machine;

a circulation pump driving unit which drives the pump motor;

drain valve driving unit which controls outputting of the washing water to the outside of the washing machine; and a water supply value driving unit which controls inflow of the washing water to the washing machine, wherein the display, motor driving, circulation pump driving, drain valve driving, and water supply valve driving units are connected to corresponding output terminals of the control unit.

9. A washing machine control method of controlling a washing machine having a spin-drying tub, a washing board which is mounted on an inner surface of a bottom of the spin-drying tub and wobbles to wash laundry, and a drive motor which drives the spin-drying tub and the washing board, the method comprising:

primarily detecting a weight of the laundry using an amount of current flowing through the drive motor while the drive motor is operated to drive the spin-drying tub, having the laundry therein before the washing water is supplied, and the washing board;

primarily supplying an amount of washing water corresponding to the primarily detected weight of the laundry to the washing machine;

secondarily detecting the weight of the laundry while operating the drive motor in a wobbling position:

determining a target water level according to the secondarily detected weight of the laundry;

secondarily supplying washing water to the tub corresponding to the target water level; and carrying out a washing operation, a rinsing operation and a spin-drying operation of the washing machine by wobbling the washing board, in response to the supplying of the washing water being completed.

10. The washing machine control method according to claim 9, wherein the primarily supplying of the washing water comprises supplying the washing water to a minimum water level required to wash the laundry.

11. The washing machine control method according to claim 9, wherein the carrying out of the spin-drying operation comprises rotating the washing board, together with the spin-drying tube, in a wobbling position of the washing machine.

12. The washing machine control method according to claim 11, further comprising shaking the laundry contained in the spin-drying tub by wobbling the washing board in response to elapse of a predetermined time after the spin-drying operation.

13. The washing machine control method according to claim 9, wherein the detecting of the weight of the laundry comprises:

operating the drive motor to drive the drive motor; and obtaining current data after the operating of the drive motor for a predetermined time.

14. The washing machine control method according to claim 13, wherein the obtaining of the current data comprises taking the current data at preset intervals and calculating a final current data by averaging the current data taken at the preset intervals.

15. The washing machine control method according to claim 9, wherein the secondarily detecting of the weight of the laundry comprises detecting the weight of the laundry while operating the drive motor in a wobbling position of the washing machine.

16. A washing machine control method of controlling a washing machine having a spin-drying tub, a washing board which is mounted on an inner surface of a bottom of the spin-drying tub and wobbles to wash laundry, and a drive motor which drives the spin-drying tub and the washing board, the method comprising:

detecting a weight of the laundry using an amount of current flowing through the drive motor while the drive motor is operated to drive the spin-drying tub, having the laundry therein, and the washing board;

supplying a proper amount of washing water corresponding to the detected weight of the laundry to the washing machine; and carrying out a washing operation, a rinsing operation and a spin-drying operation of the washing machine by wobbling the washing board, in response to the supplying of the washing water being completed, wherein the carrying out of the rinsing operation comprises:

providing the washing board to a wobbling position of the washing machine and wobbling the washing board to disentangle the laundry;

providing the washing board to a level position of the washing machine while supplying rinsing water to the washing machine and rotating the washing board at a predetermined low speed, together with the spin-drying tub; and performing a wobbling rinsing by wobbling the washing board in response to a water level of the rinsing water being a predetermined rinse water level.

* * * * *

UNITED STATES PATENT AND TRADEMARK OFFICE

CERTIFICATE OF CORRECTION

PATENT NO. : 7,047,583 B2
APPLICATION NO. : 10/318104
DATED : May 23, 2006
INVENTOR(S) : Hyung-Kyoon Kim et al.

It is certified that error appears in the above-identified patent and that said Letters Patent is hereby corrected as shown below:

Column 7, Line 36, change “position”: to --position--;

Signed and Sealed this

Seventh Day of November, 2006

JON W. DUDAS
*Director of the United States Patent and Trademark Office*